United States Patent [19]

Steingroever

[11] 4,150,927

[45] Apr. 24, 1979

[54] MOLD FOR THE PRODUCTION OF ANISOTROPIC PERMANENT MAGNETS

[75] Inventor: Erich A. Steingroever, Bonn, Fed. Rep. of Germany

[73] Assignee: Magnetfabrik Bonn, GmbH vormals Gewerkschaft Windhorst, Bonn, Fed. Rep. of Germany

[21] Appl. No.: 784,649

[22] Filed: Apr. 4, 1977

[30] Foreign Application Priority Data

Jul. 3, 1976 [DE] Fed. Rep. of Germany ..... 2629990

[51] Int. Cl.[2] ..... B22F 3/00; B30B 11/04

[52] U.S. Cl. ..... 425/3; 425/78; 425/354; 425/174.8 R

[58] Field of Search ..... 425/78, 3, 352, 354, 425/356, 174.8; 264/22; 164/146, 147

[56] References Cited

U.S. PATENT DOCUMENTS

| | | | |
|---|---|---|---|
| 2,324,645 | 7/1943 | Prehler | 425/3 |
| 2,437,127 | 3/1948 | Richardson | 425/78 X |
| 3,274,303 | 9/1966 | Muller | 425/3 |
| 3,416,191 | 12/1968 | Richter et al. | 425/78 X |
| 3,555,597 | 1/1971 | Meadows | 425/78 |
| 3,555,,621 | 1/1971 | Hara | 425/3 |
| 3,564,654 | 2/1971 | Steingroever | 425/78 |
| 3,732,056 | 5/1973 | Eddy et al. | 425/78 |

FOREIGN PATENT DOCUMENTS

| | | | |
|---|---|---|---|
| 1270470 | 6/1968 | Fed. Rep. of Germany | 425/78 |

*Primary Examiner*—Robert L. Spicer, Jr.
*Attorney, Agent, or Firm*—Fisher, Christen & Sabol

[57] ABSTRACT

A mold for producing anisotropic permanent magnets consists of a cavity defined by a thin-walled tubular lining element closely surrounded by an electrical field coil, reinforced by a metal ring enclosing the field coil so that a magnetic field of a given strength can be generated in the cavity with less power than in the case of the conventional field coil normally positioned at a relatively greater distance from the interior of the cavity. The lining element can be composed of a non-metallic material such as a ceramic, or sintered $Al_2O_3$.

17 Claims, 1 Drawing Figure

MOLD FOR THE PRODUCTION OF ANISOTROPIC PERMANENT MAGNETS

Figure 1:
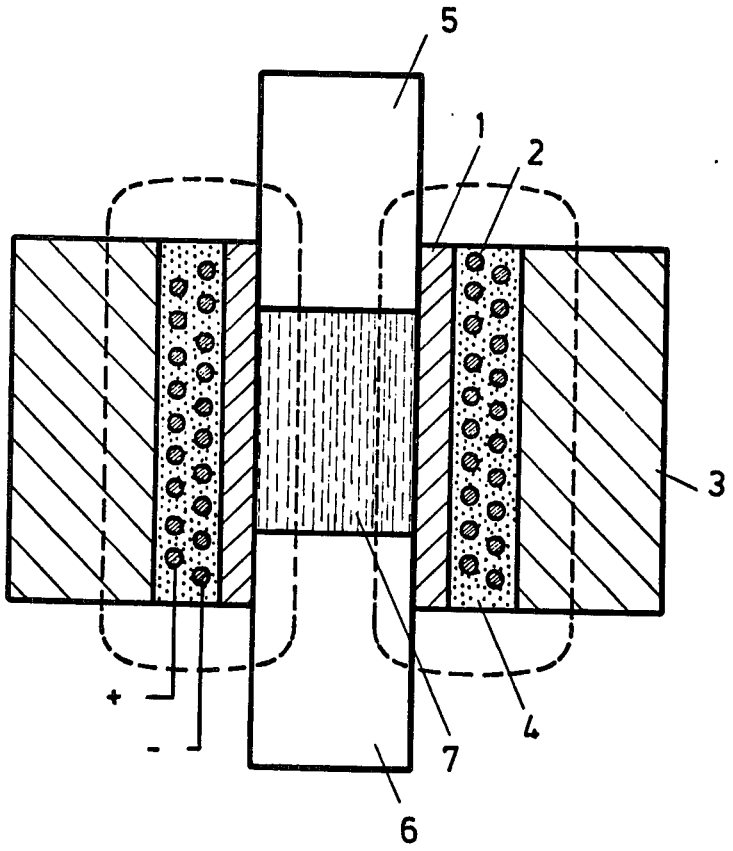

This invention relates to a pressing tool for the production of anisotropic permanent magnets made from a permanent magnet powder.

The production of permanent magnets from permanent magnet powders by compacting the powder in a molding press, either with, or without, a binder is well-known and a typical apparatus of the prior art used for this purpose is disclosed in U.S. Pat. No. 3,274,303, issued to Werner Müller in 1966. Permaent magnets which are produced without a binder (such as Alnico and $SmCo_5$ magnets) are subsequently sintered at high temperatures or, in the case of ferrite magnets, calcined. Permanent magnets which include a binder are finished by the application of heat while in the mold or after being ejected from the mold.

Anisotropic permanent magnets are defined as magnets which have a preferred magnetic direction in which direction the magnetic values, such as remanence or coercitive field strength and/or maximum energy product $BH_{max}$ are greater in one direction than in others. In the production of magnets of this type the powder particles which are introduced into the mold are inherently anisotropic so that they can be aligned in their preferred direction by being subjected to a magnetic field either prior to introduction into the mold or during the process of charging the mold.

Normally the pressing tool consists of a wear-resistant lining, or sleeve, made of tempered steel or a hard metal which is tightly enclosed by a reinforcing collar in order for the lining to be able to withstand the high molding pressures developed by the reciprocatory ram which enters the mold cavity to compress the powder therein into a formed magnetic body.

In the usual form of pressing tool for the production of anisotropic permanent magnets under pressure and the influence of a directional magnetic field, the magnetic field is generated by an electrical coil, or coils, which are disposed around each of the press rams or the entire mold. Thus the coils which generate the magnetic field are relatively remote from the cavity in which the magnet body is formed so that they must be greatly over-dimensioned in size, and consequently their consumption of current is excessive in order to produce a magnetic field having the necessary strength in the cavity itself. Generally, in the case of ferrite magnets a directional field strength of between 1,000 to 4,000 A/cm is used, and in the case of $SmCo_5$ magnets field strengths of up to 20,000 A/cm are used.

Therefore an object of the present invention is to provide a pressing mold wherein the magnetic directional field can be generated in the cavity by means of a coil of smaller dimensions than hitherto considered possible and thus with a lower consumption of electric power or, in the alternative, to obtain greater field strengths in the cavity with the use of the same electrical power consumption.

According to the present invention the magnetic field generating means includes an electrical coil which is disposed directly around the inner lining of the mold and inside the reinforcing collar.

In the drawing, the single figure illustrates a cross-section of a preferred form of the invention.

In the drawing the numeral 1 indicates the innermost layer, or lining, of the press mold which preferably comprises a thin-walled sleeve of a wear-resistant material closely surrounded by a magnetic field generating means which, in turn is surrounded by a reinforcing ring 3 made of steel, or other ferromagnetic material and which comprises the outermost layer of the mold. The numerals 5 and 6 indicate a pair of reciprocatory press rams preferably constructed of ferromagnetic material. These rams enter the cavity 7,defined by the innermost layer 1 of the mold, to compress magnetic powder deposited in the cavity into magnetic bodies. The magnetic field generating means preferably consists of two layers of copper wire, indicated by numeral 2, or copper tubing through which water may be circulated for cooling purposes, the ends of the coil being connected to a source of direct current. Also, in the preferred form of the invention the wire, or tubing, may be embedded in an incompressible filler, indicated by numeral 4, such as quartz or $Al_2O_3$ powder.

Thus it can be seen, from the drawing that the magnetic field generating means, consisting of the wire or tubing 2, is essentially embedded in the mold between the inner layer 1 and the outer layer 3 so that it generates a generally elongated toroidal magnetic field, indicated by the dotted lines, which travels axially in one direction through the cavity 7 and in the opposite direction predominantly through the outer ferromagnetic ring 3.

According to the present invention, the thin-walled tubular lining 1 may consist of a magnetic material such as tempered steel or some other hard metal. Alternatively, it may be fabricated from a non-magnetic material, especially a wear-resistant ceramic material, such as $Al_2O_3$. In the case of the latter, neither stray currents nor magnetic short currents will occur in the lining, so that a high intensity of the magnetic field may be achieved in the cavity 7.

Furthermore, in practicing the present invention the radial thickness of the inner layer, or lining, 1 may be less than 20% of the inside diameter of the lining and preferably the radial thickness is less than 10% of the lining's inside diameter.

In a specific example of a press tool made in accordance with this invention the tubular inner layer 1 consisted of sintered $Al_2O_3$ having an inside diameter of 30mm and an outside diameter of 36mm on which was wound two layers of copper wire to form the electrical coil 2, the diameter of the wire being 2mm. The outer layer 3 consisted of magnetic steel having an inside diameter of 44mm with a radial wall thickness of 30mm. The space between the outer layer 3 and the inner layer 1 was filled with an epoxy resin, the particles of which included a high proportion (at least 50% by volume) of $Al_2O_3$ powder so that the winding 2 was completely encapsulated.

The strength of the mold described immediately above was such that molded magnet bodies could be produced from anisotropic barium ferrite powder in the mold under pressure exerted by the rams 5 and 6 amounting to 1,000 kg/cm$^2$. When a higher molding pressure was exerted in the cavity of the mold it was still usable despite a crack in the inner lining. In the foregoing examples the coil 2 was connected to a pulsed source of direct current having a power of 750 watts which produced a directional magnetic field in the cavity 7 in excess of 30,000 A/cm.

What is claimed is:

1. A mold for use with at least one reciprocatory ram for the production of anisotropic permanent magnets from permanent magnet powder under the influence of a magnetic field, said mold having a cavity to receive said ram for compacting said particles within said cavity under pressure, said cavity being defined by tubular relatively thin-walled lining, a radially incompressible electrical field coil means closely surrounding said lining, and means for reinforcing said field coil means and said lining against excessive radially outwardly directed forces generated within said cavity.

2. A mold as defined in claim 1, wherein said reinforcement means comprises a ferromagnetic ring surrounding said coil and lining.

3. A mold as defined in claim 1, wherein the radial thickness of the lining is less than 20% of the diameter of the cavity defined by said lining.

4. A mold as defined in claim 3, wherein said thickness is less than 10% of said diameter.

5. A mold as defined in claim 2, wherein said electrical field coil means comprises an electrical conductor embedded in a mass of electricaly non-conductive material disposed between said lining and said reinforcing ring.

6. A mold as defined in claim 5, wherein said electrically non-conductive material occupies at least 50% of the volume of the space between said lining and said reinforcing ring.

7. A mold as defined in claim 6, wherein said electrically non-conductive material comprises an incompressible powder.

8. A mold as defined in claim 7, wherein said incompressible powder comprises $Al_2O_3$.

9. A mold as defined in claim 1, wherein said tubular lining element comprises an electrically non-conductive material.

10. A mold as defined in claim 9, wherein said tubular lining element comprises ceramic material.

11. A mold as defined in claim 10, wherein the radial thickness of the lining is less than 20% of the diameter of the cavity defined by said lining.

12. A mold as defined in claim 11, wherein said thickness is less than 10% of said diameter.

13. A mold as defined in claim 10, wherein said ceramic material comprises sintered $Al_2O_3$.

14. A mold having a cavity for coaction with at least one reciprocatory cylindrical press ram for compacting particulate materials under pressure and the influence of a magnetic field to produce anisotropic permanent magnet bodies, the innermost layer of material forming the mold comprising a wear-resistant material, an outer layer of the mold comprising ferromagnetic material, and tubular radially incompressible magnetic field generating means embedded in said mold between said inner and outer layers for generating an elongated toroidal magnetic field which passes axially through said cavity in one direction and predominantly through said outer layer of the mold in the opposite direction.

15. A mold as defined in claim 14, wherein said inner layer comprises a ceramic material.

16. A mold as defined in claim 5, wherein said inner layer comprises $Al_2O_3$.

17. A mold as defined in claim 16, wherein said magnetic field generating means comprises an electrical coil embedded in a binder which includes at least 50% of $Al_2O_3$ powder.

* * * * *